US008542183B2

(12) United States Patent
Nose et al.

(10) Patent No.: US 8,542,183 B2
(45) Date of Patent: Sep. 24, 2013

(54) DISPLAY DEVICE, SIGNAL LINE DRIVER, AND DATA TRANSFER METHOD

(75) Inventors: Takashi Nose, Kanagawa (JP); Yoshihiko Hori, Kanagawa (JP)

(73) Assignee: Renesas Electronics Corporation, Kawasaki-Shi, Kanagawa (JP)

( * ) Notice: Subject to any disclaimer, the term of this patent is extended or adjusted under 35 U.S.C. 154(b) by 17 days.

(21) Appl. No.: 13/067,789

(22) Filed: Jun. 27, 2011

(65) Prior Publication Data

US 2012/0038621 A1 Feb. 16, 2012

(30) Foreign Application Priority Data

Aug. 16, 2010 (JP) ..... 2010-181975

(51) Int. Cl.
*G09G 3/36* (2006.01)

(52) U.S. Cl.
USPC ..... 345/103; 345/98

(58) Field of Classification Search
USPC ..... 345/87–100, 103
See application file for complete search history.

(56) References Cited

U.S. PATENT DOCUMENTS

| | | | | |
|---|---|---|---|---|
| 6,407,730 | B1 | 6/2002 | Hori | |
| 7,830,353 | B2 * | 11/2010 | Chen et al. | 345/100 |
| 2008/0007504 | A1 * | 1/2008 | Kawaura et al. | 345/89 |
| 2009/0243981 | A1 * | 10/2009 | Chen et al. | 345/87 |
| 2010/0053123 | A1 * | 3/2010 | Hori | 345/204 |

FOREIGN PATENT DOCUMENTS

| | | | |
|---|---|---|---|
| JP | 2000-155552 | A | 6/2000 |
| JP | 2009-204677 | A | 9/2009 |

OTHER PUBLICATIONS

K. Yamaguchi et al. in "A 2.0 Gb/s Clock-Embedded Interface for full-HD 10b 120Hz LCD drivers with 1/5-Rate Noise Tolerant Phase and Frequency Recovery," 2009 IEEE International Solid-State Circuits Conference Digest of Technical Papers, pp. 192-193, Feb. 2009.

* cited by examiner

*Primary Examiner* — Amr Awad
*Assistant Examiner* — Damon Treitler
(74) *Attorney, Agent, or Firm* — McGinn Intellectual Property Law Group, PLLC

(57) ABSTRACT

A liquid crystal display device includes a timing controller, a liquid crystal display panel, multiple data drivers, and gate drivers. The timing controller supplies control data to specified drivers among the data drivers. The specified drivers generate gate driver control signals to control gate drivers in response to the control data, and supply gate driver control signals to the gate drivers.

12 Claims, 6 Drawing Sheets

DISPLAY DEVICE, SIGNAL LINE DRIVER, AND DATA TRANSFER METHOD

CROSS-REFERENCE TO RELATED APPLICATIONS

The disclosure of Japanese Patent Application No. 2010-181975 filed on Aug. 16, 2010 including the specification, drawings and abstract is incorporated herein by reference in its entirety.

BACKGROUND

The present invention relates to a display device, signal line driver, and data transfer method, and relates in particular to technology for generating and transferring control signals in display devices.

Increasingly large-sized panel display devices and larger data transfer quantities due to improved panel picture image resolution cause problems in methods for transferring data to drivers to drive display devices. In liquid crystal display devices for example, the data transfer technology for supplying video data from the timing controller to the data driver (or signal line driver, source driver) for driving the data lines (signal lines) in the liquid crystal display panel becomes a problem.

Under these circumstances the problem is especially serious when driving large-sized display panels. Large-size display panels contain multiple data drivers for driving the data lines. Currently made large-size display devices contain a common bus to reduce the number of wires and in many cases the applicable common bus transfers the video data successively to the data drivers, however this type of arrangement has the problem of requiring an excessively large data transfer rate. More specifically, the allowable time for sending this video data to a single data driver when setting the horizontal synchronization time length as TH, and the number of data drivers as N, is TH/N. Increasing the number of data drivers to cope with large-sized display devices and better panel resolution therefore signifies that the allowable time for sending video data to a single data driver becomes ever shorter.

One technique for resolving this type of problem is transferring the video data point-to-point to the respective plural data drivers. FIG. 1 is a block diagram showing one example of a configuration in a large-size liquid crystal display device for transferring video data by the point-to-point technique to the data drivers. The technology for the structure in FIG. 1 is disclosed in Japanese Unexamined Patent Application Publication No. 2000-155552. The liquid crystal display device 110 in FIG. 1 includes a signal processor circuit 120, a liquid crystal panel 130, source drivers 202-216, and gate drivers 402-408. Separate lines supply the video data to the respective source drivers 202-216.

In the liquid crystal display device 110 in FIG. 1, the signal processor circuit 120 supplies gate driver clock GCLK to the respective gate drivers 402-408, while gate driver start pulses GSP on the other hand are supplied only to the gate drivers 402 positioned on the ends. After a specified time has elapsed after receiving a gate driver start pulse GSP from the signal processor circuit 120, the gate driver 402 supplies a gate driver start pulse to the gate driver 404. The gate drivers 406 and 408 receive a gate driver start pulse from the adjacent gate drivers 404, 406 in the same way.

The technique for transferring video data point-to-point to the respective plural data drivers alleviates restrictions on the data transfer rate but causes the problem of requiring a larger number of wires coupled to applicable devices and a larger number of output pins on the device (typically a timing controller) that supplies video data to each data driver. The liquid crystal display device in FIG. 1 lowers the number of required wires and output pins by using serial data transfer but the number of output pins and wires should preferably be kept as small as possible in view of the need to lower costs and simplify the equipment.

One technique for reducing the number of output pins and wiring couplings on the timing controller utilizes multiplexed signals as control signals for data driver control in video data signals used to transfer video data. One data transfer method for example utilizes clock signals generated from video data CDR (clock data recovery) to send video data to data drivers and send the video data and clock signals along the same wire and so is effective in reducing the number of wires. This technique is disclosed in Japanese Unexamined Patent Application Publication No. 2009-204677 and by K. Yamaguchi et al. in "A 2.0 Gb/s Clock-Embedded Interface for full-HD 10b 120 Hz LCD drivers with ⅕-Rate Noise Tolerant Phase and Frequency Recovery," 2009 IEEE International Solid-State Circuits Conference Digest of Technical Papers, pp. 192-193, February, 2009.

SUMMARY

The inventors perceived that improving data transfer methods in panel display devices requires making a study including the supply of control signals to gate drivers (or scanning line drivers) that drive gate lines (or scanning lines). In large-size liquid crystal display devices the video data signals are generally supplied to the data driver by way of wires formed as flexible flat cables (FFC) and printed circuit boards (PCB). In these types of structures, forming wires for transferring video data signals on FFC and PCB in parallel with wires supplying control signals to gate drivers is a primary factor in higher FFC and PCB costs. Moreover, installing wires to supply control signals to the gate driver in parallel with wires to transfer video data might cause adverse effects such as common noise generated by control signals supplied to the gate driver, into the wiring that transfers the video data. These effects become an especially serious problem when employing high-speed serial interfaces for transferring video data signals. The above related art literature makes no mention whatsoever of problems in supplying control signals to the gate driver.

In one aspect of the present invention, the display device includes a display panel, a timing controller, multiple signal line drivers for driving the display panel signal lines, and a scanning line driver for driving the scanning lines in the display panel. The timing controller supplies control data to specified drivers among the plural signal line drivers. The specified driver generates scanning line driver control signals for controlling scanning line drivers in response to the control data, and supplies scanning line driver control signals to the scanning line driver.

In another aspect of the present invention, the signal line driver includes a receiver to accept transfer data including video data and control data from the timing controller, a drive circuit to drive the display panel signal line in response to the video data, and a control signal generator circuit to generate control signals for controlling the scanning line drivers to drive the scanning lines on the display panel in response to the control data.

Yet another aspect of the present invention provides a data transfer method for a display device including a display panel, a timing controller, multiple signal line drivers for driving the display panel signal lines, and a scanning line driver for driving the scanning lines on the display panel. The applicable data transfer method includes the steps of: supplying control data to control the scanning line driver from the timing controller to the specified driver among multiple signal line drivers; generating control signals to control the scanning line drivers in a specified driver in response to control data, and supplying control signals from a specified driver to the scanning line driver.

The present invention is capable of rendering a display device with a reduced number of wires required for supplying video data and control signals, and that eliminates effects from noise that control signals supplied to the scanning line driver exert on the data transfer lines that supply video data.

DETAILED DESCRIPTION

Figure 1:
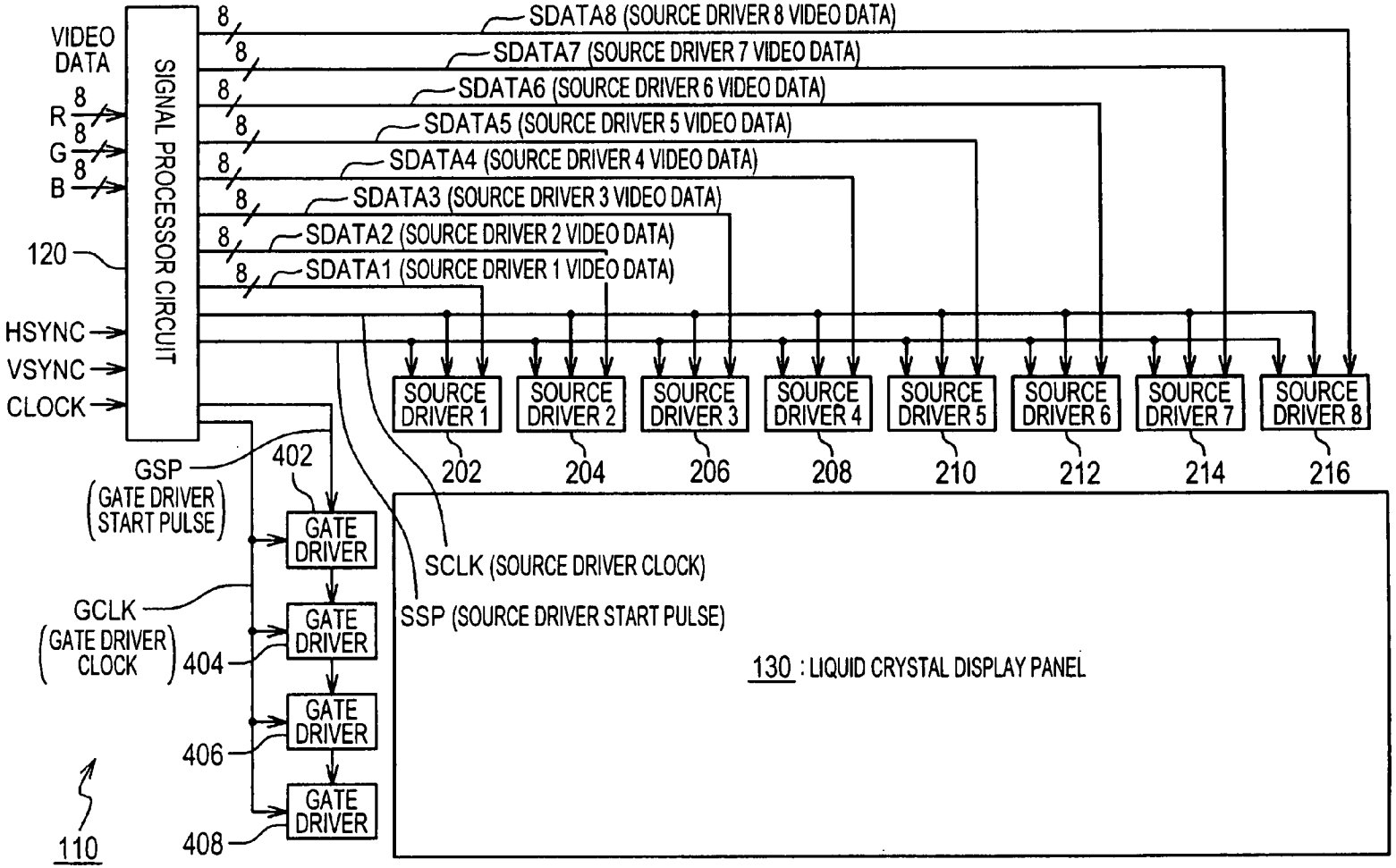
FIG. 1 is a block diagram for showing the structure of the display device of the related art.
Figure 2:
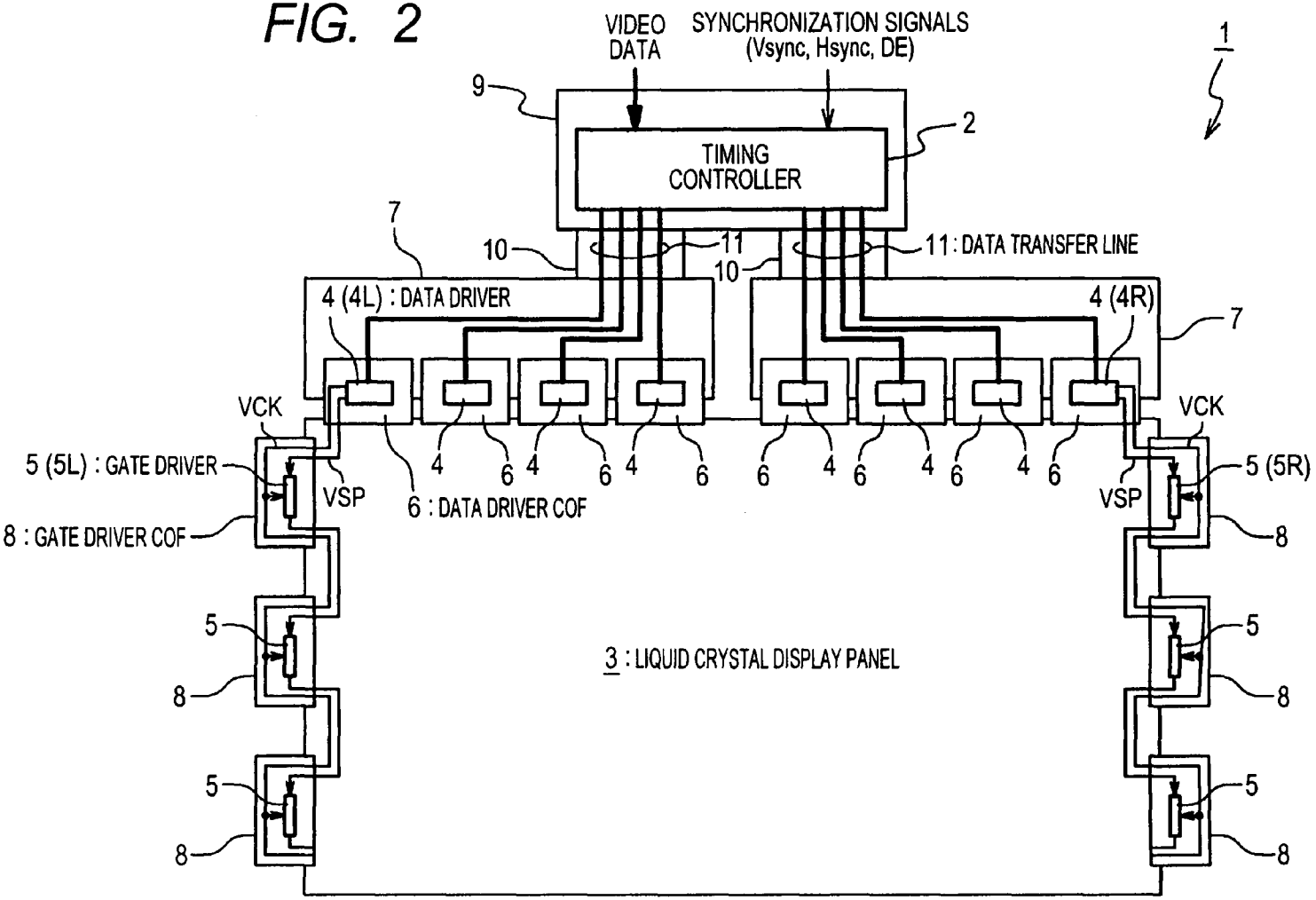
FIG. 2 is a block diagram for showing the structure of the display device of the first embodiment of the present invention.

FIG. 2 is a drawing for describing the structure of the display device of the embodiment of the present invention. The display device in FIG. 2 serving as the display device 1 includes a timing controller 2, a liquid crystal display panel 3, multiple data drivers 4, and multiple gate drivers 5. The liquid crystal display panel 3 includes gate lines (scanning lines), data lines (signal lines), and pixels formed in the vicinity of positions where these gate lines and data lines intersect. The data drivers 4 drive the data lines of the liquid crystal display panel 3, and the gate driver 5 drives the gate lines of the liquid crystal display panel 3. The timing controller 2 supplies video data (in other words, data indicating the hierarchy of each pixel in the liquid crystal display panel 3), and controls the data drivers 4 and gate drivers 5 in response to the synchronized signals (e.g. Vsync, Hsync, data validity period DE) supplied to the timing controller 2.

The timing controller 2, data driver 4, and gate driver 5 are formed in the liquid crystal display device 1 of this embodiment as follows. The plural data drivers 4 are each formed over the data driver COF (chip on film) substrate 6, and that data driver COF substrate 6 is mounted over the PCB 7. This embodiment utilizes two PCB7 as left and right boards. Each of the plural gate drivers 5 is mounted over the gate driver COF substrate 8, and timing controller 2 is mounted over the PCB9. The FFC10 (flexible flat cable) couples the PCB9 where the timing controller 2 is mounted, to the PCB7 where the data drivers 4 are mounted.

The timing controller 2 is coupled to the data drivers 4 by a data transfer line 11 mounted over the data driver COF substrate 6, PCB7, FFC10, and PCB9. The present embodiment employs a point-to-point data interface for communications between the timing controller 2 and each data driver 4. Namely, separate data transfer lines 11 are utilized for data transfer to each data driver 4.

In the liquid crystal display device 1 of this embodiment, the video data and control data for controlling the data drivers 4 are encoded into signals sent to each data driver 4 via the data transfer line 11. There is no dedicated control wiring for controlling the data driver 4. This arrangement serves to reduce the number of wires formed on the data driver COF substrate 6, PCB7, FFC10, and PCB9.

Furthermore, in the liquid crystal display device 1 of this embodiment, the control data for controlling the gate drivers 5 is supplied to the data drivers 4 positioned on both ends of the timing controller 2. The data drivers 4 positioned on both ends generate gate driver control signals for controlling the gate drivers 5 in response to that control data. The control data for controlling the gate drivers 5 is encoded into signals sent to each data driver 4 by way of the data transfer line 11, the same as control data for controlling the video data and data driver 4. In FIG. 2, the data driver 4 positioned on the left end is denoted by the code 4L, and the data driver 4 positioned on the right end is denoted by the code 4R.

Stated in more detail, the data driver 4L positioned on the left end supplies a vertical clock signal VCK to the gate driver 5 mounted on the left side of the liquid crystal display panel 3. The data driver 4L also supplies a vertical start pulse VSP to the gate driver 5L closest to the data driver 4L. The vertical clock signal VCK is a clock signal used for operating the gate driver 5. The vertical start pulse VSP is a signal specifying the timing for starting the drive on the gate lines of the respective gate driver 5 installed on the left side of the liquid crystal display panel 3. When a specified amount of time has elapsed after receiving the vertical start pulse VSP the gate driver 5L supplies a vertical start pulse VSP to the gate driver 5 adjacent to the gate driver 5L. Vertical start pulses VSP are sequentially supplied in the same way to the other gate drivers 5 mounted on the left side of the liquid crystal display panel 3.

The gate driver 4R positioned on the right end, supplies a vertical clock signal VCK to the gate driver 5 mounted on the right side of the liquid crystal display panel 3 in the same way. The data driver 4R also supplies a vertical start pulse VSP to the gate driver 5R that is closest to the data driver 4R. When a specified amount of time has elapsed after receiving the vertical start pulse VSP, the gate driver 5R supplies a vertical start pulse VSP to the gate driver 5 adjacent to the gate driver 5R. Vertical start pulses VSP are sequentially supplied in the same way to the other gate drivers 5 mounted on the right side of the liquid crystal display panel 3.

An important fact to understand here is that in the liquid crystal display device 1 of this embodiment, there are no wires directly coupling the timing controller 2 and the gate drivers 5. The absence of direct wiring is not only effective in reducing the number of wires formed in the data driver COF substrate 6, PCB7, FFC10, and PCB9 but also eliminates the need to form wires to supply gate driver control signals in parallel with the data transfer lines 11 and so is effective in preventing effects from noise in the data transfer lines 11. The supply of control data to the data drivers 4 from the timing controller 2, and the generating of gate driver control signals by the data driver 4 in a liquid crystal display device 1 with the above structure are described next in detail.

Figure 3:
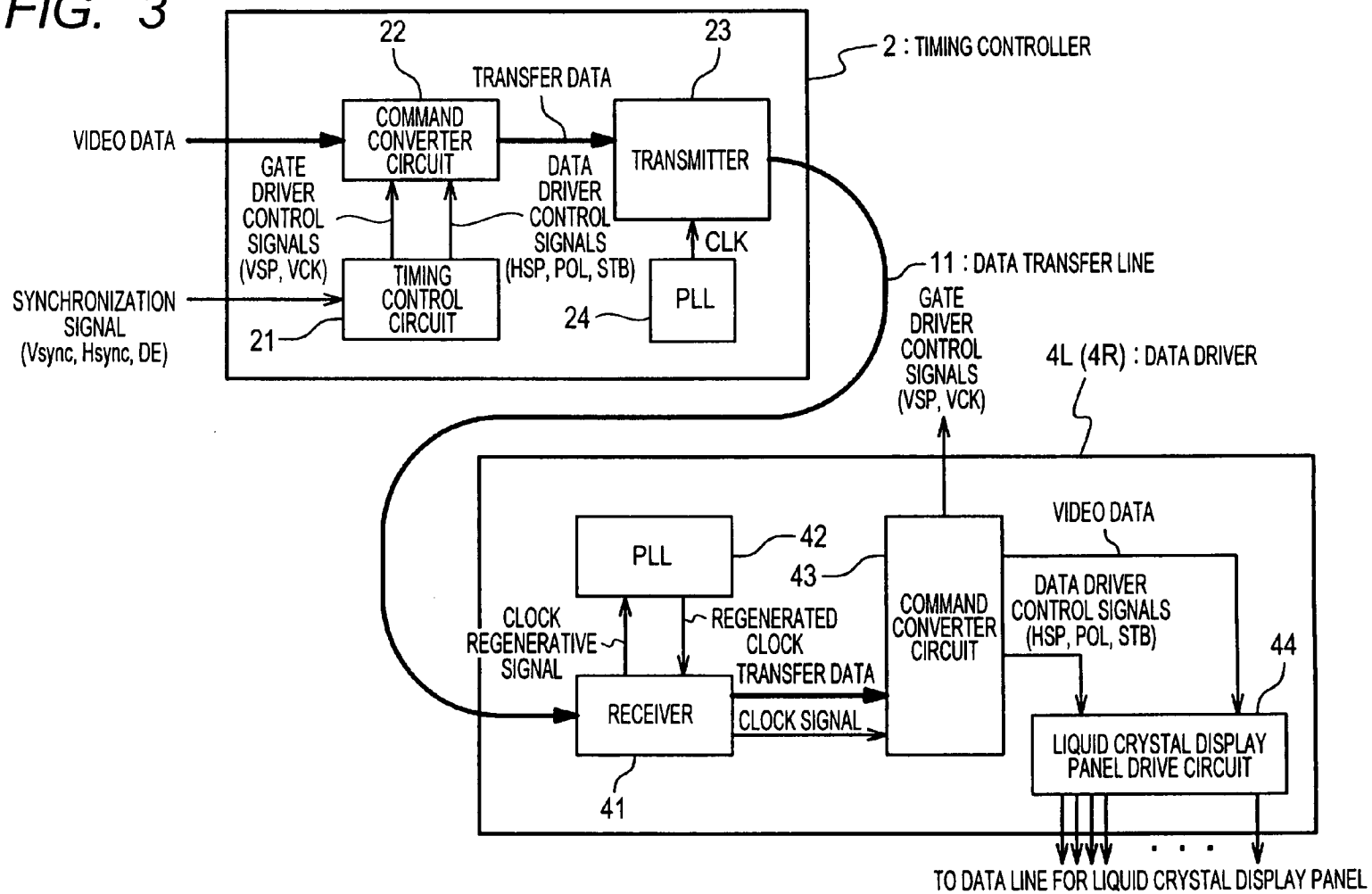
FIG. 3 is a block diagram for showing the structure of the timing controller and data driver in the first embodiment of the present invention.

FIG. 3 is a block diagram showing the structure of the timing controller 2 and the data drivers 4L and 4R in the present embodiment. Hereafter one should note that the data drivers 4L and 4R are the data drivers positioned on both ends of the timing controller as described above and these data drivers 4L and 4R generate gate driver control signals for controlling the gate driver 5. The timing controller 2 includes a timing control circuit 21, a command converter circuit 22, a transmitter 23, and a PLL 24. The timing control circuit 21, command converter circuit 22, transmitter 23, and PLL 24 are all monolithically integrated onto a single chip.

The timing control circuit 21 generates data driver control signals and gate driver control signals in response to synchronous signals (e.g. vertical synchronization signals Vsync, horizontal synchronization signals Hsync, data enable signals DE) supplied from external sections. These generated gate driver control signals include vertical start pulses VSP and vertical clock signals VCK. The data driver control signal on the other hand, includes the horizontal start pulse HSP, the polarized signal POL, and the strobe signal STB. The horizontal start pulse HSP is a pulse for notifying the each data driver 4 of the start of the horizontal synchronization period. The polarized signal POL is a signal for specifying the drive voltage polarity for driving the data line to each data driver 4. The strobe signal STB is a signal for specifying the timing at which the latch circuit contained in each data driver 4 latches the video data.

Figure 4:
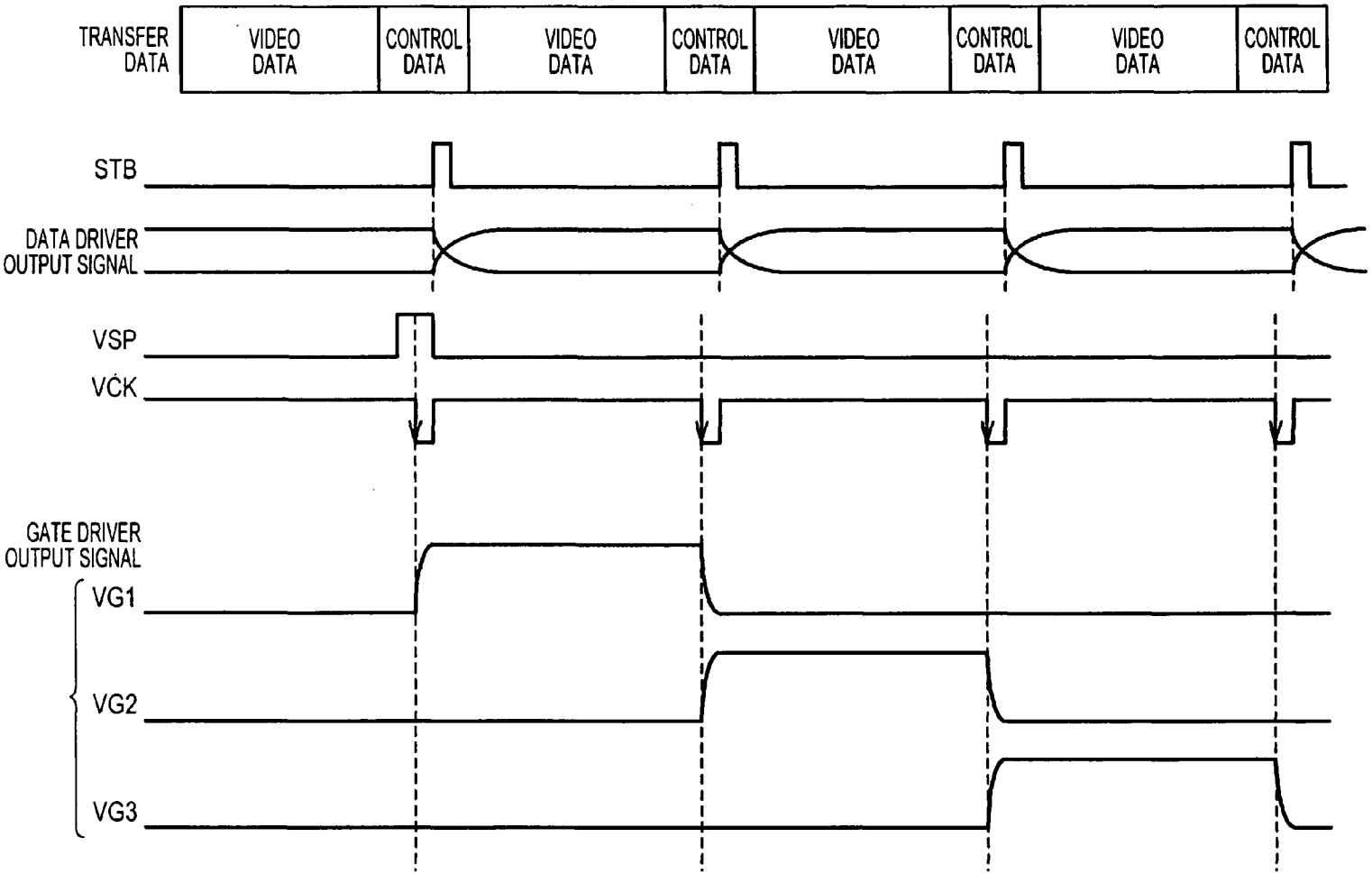
FIG. 4 is a timing chart for showing the operation of the data driver and gate driver in the first embodiment of the present invention.

The command converter circuit 22 encodes the video data, gate driver control signals, and data driver control signals, and generates the transfer data. The generated transfer data as shown in FIG. 4 contains video data and control data. This control data includes command data for specifying the timing that the gate driver control signals (VSP, VCK) are respectively asserted; and command data for specifying the timing that the data driver control signals (HSP, POL, STB) are respectively asserted.

Returning now to FIG. 3, the transmitter 23 synchronizes with the clock signal CLK accepted from the PLL (phase locked loop) 24 and generates data transfer signals corresponding to the transfer data, and sends the generated data transfer signals by way of the data transfer line 11 to the data drivers 4L, 4R. These data transfer signals are generated in formats corresponding to the regenerated clock or clock data recovery (CDR). The data drivers 4L and 4R perform clock data recovery or in other words generate the clock corresponding to the data transfer signal sent by way of the data transfer line 11.

The data drivers 4L, 4R on the other hand include a receiver 41, a PLL 42, a command converter circuit 43, and liquid crystal display panel driver circuit 44. Here, one should note that the receiver 41, the PLL 42, the command converter circuit 43, and the liquid crystal display panel driver circuit 44 are all monolithically integrated onto a single chip. The receiver 41 and the PLL 42 include a function for regenerating transfer data from the data transfer signal. More specifically, the receiver 41 performs waveform restoration on the data transfer signal received from the timing controller 2, generates a clock recovery or regeneration signal, and supplies the applicable clock recovery signal to the PLL 42. The PLL42 regenerates the clock signal by performing clock recovery or regeneration of the clock recovery signal. The receiver 41 samples the data transfer signal synchronized with this regenerated clock signal and regenerates the transfer data. The transfer data as already described above contains video data and control data so that the data drivers 4L, 4R consequently generate this video data and control data.

The command converter circuit 43 supplies the video data contained in the transfer data to the liquid crystal display panel drive circuit 44. The command converter circuit 43 in addition functions as a control signal generator circuit to generate gate driver control signals (VSP, VCK) and data driver control signals (HSP, POL, STB) in response to control data contained in the transfer data. As was already described, the control data contains command data for specifying the timing that the respective gate driver control signals (VSP, VCK) are asserted; and command data for specifying the timing that the respective data driver control signals (HSP, POL, STB) are asserted which allows recovering or regenerating the gate driver control signals and the data driver control signals. The data driver control signals are supplied to the liquid crystal display panel drive circuits 44, and the gate driver control signals are supplied to the corresponding gate drivers 5.

The liquid crystal display panel drive circuit 44 drives each data line of the liquid crystal display panel 3 in response to the video data. The data driver control signals (HSP, POL, STB) control the polarity of the drive voltages on each data line and the operation timing of the liquid crystal display panel drive circuit 44.

Data drivers 4 other than the data drivers 4L, 4R may include a function for generating gate driver control signals (VSP, VCK) the same as in the data drivers 4L and 4R, and may or may not include a function for generating gate driver control signals (VSP, VCK). However, from the point of view of actual product manufacturing costs, data drivers 4 other than the data drivers 4L, 4R should preferably possess a structure identical to that of the data drivers 4L, 4R. Manufacturing a dedicated data driver 4 to mount for both ends is not preferable in terms of costs. In this case, in data drivers 4 other than the data drivers 4L, 4R there is no gate driver 5 coupling to the output pin that outputs the gate driver control signals (VSP, VCK). Moreover, the transfer data sent to data drivers 4 other than data drivers 4L, 4R need not include command data for specifying the timing at which each gate driver control signal (VSP, VCK) is asserted but containing command data is allowable.

FIG. 4 is a timing chart for showing the operation of the data drivers 4L, 4R and gate drivers 5L, 5R. In the present embodiment, the timing controller 2 sends video data and control data to the data drivers 4L, 4R in each horizontal synchronization period. The data drivers 4L, 4R generate data driver control signals in response to the control data. FIG. 4 is a drawing showing the strobe signal STB waveform among the data driver control signals. After the strobe signal STB is asserted, the video data sent immediately prior to it is latched, and the data line is driven according to the now latched video data. In addition, the data drivers 4L, 4R generate gate driver control signals, namely vertical gate pulses VSP and vertical clocks VCK in response to the control data. When the vertical gate pulse VSP is asserted, the gate drivers 5L, 5R start operation to sequentially drive the gate lines in synchronization with the vertical clock VCK. After the vertical gate pulse VSP is asserted, the first gate line VG1 is pulled up (raised to a certain voltage level) when the first vertical clock signal VCK is asserted. Then, when the vertical clock signal VCK is asserted, the second gate line VG2 is pulled-up (raised to a certain voltage level). The gate lines coupled to the gate drivers 5L, 5R are sequentially driven in the same way.

Figure 5:
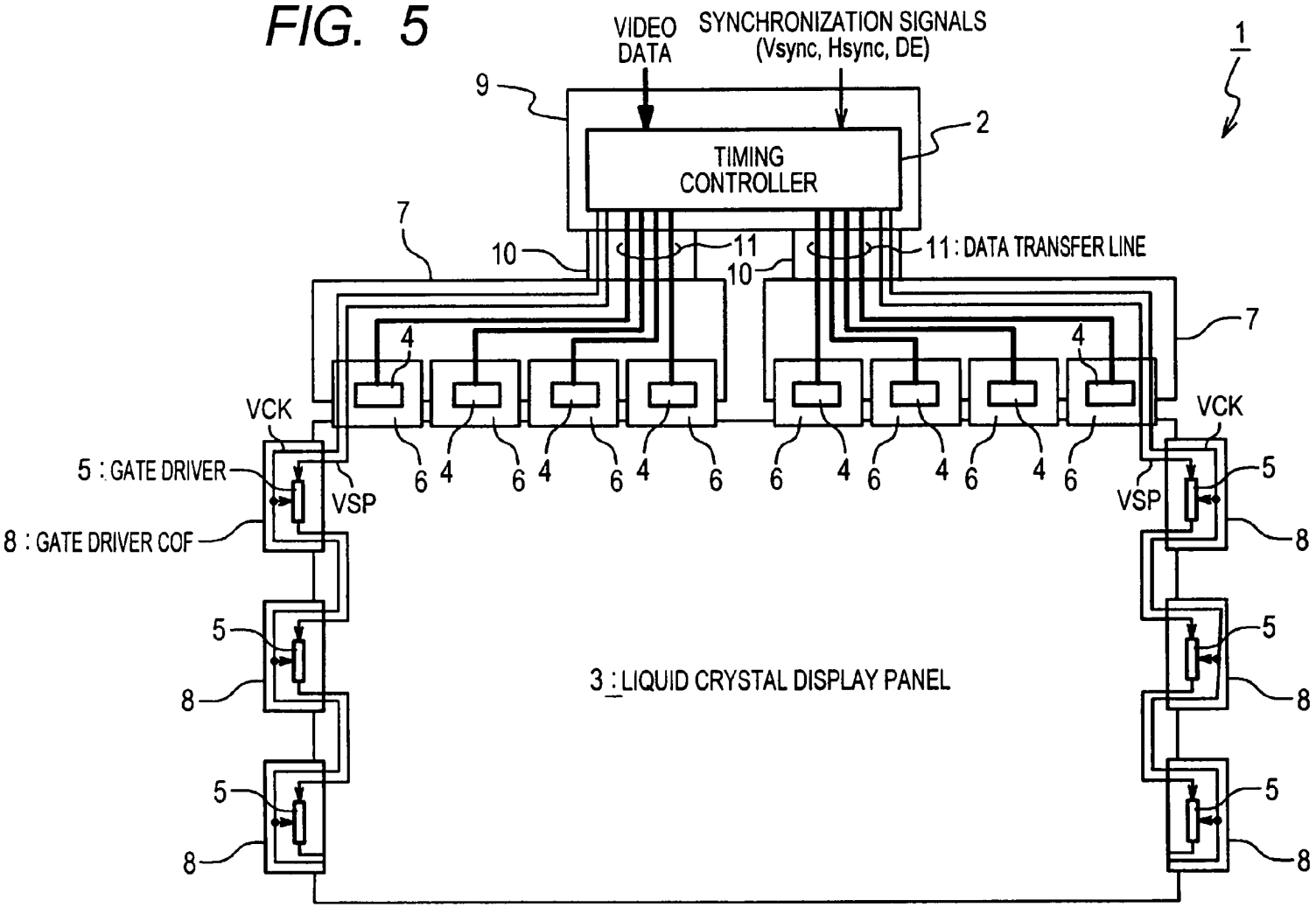
FIG. 5 is a reference example for showing a non-preferred structure of the data device.

In the liquid crystal display device 1 of the present embodiment as described above, the timing controller 2 supplies control data to the data drivers 4L, 4R positioned on both ends to control the gate driver 5, and the data drivers 4L, 4R generate gate driver control signals to control the gate driver 5 in response to this control data. There are two benefits from using a liquid crystal display device 1 with this type of structure. One benefit is that the number of output pins on the timing controller 2, and the number of wires formed over the data driver COF substrate 6, PCB7, FFC10, and the PCB9 can be reduced. This benefit is effective in lowering the cost. Another benefit is that the gate driver control signal prevents interference such as common mode noise on the data transfer line coupling the timing controller 2 with the data drivers 4L, 4R. Assuming use of a structure such as shown in the reference example in FIG. 5 in which the timing controller 2 supplies gate driver control signals (VSP, VCK) directly to the gate driver 5, then wires are formed over the data driver COF substrate 6, PCB7, FFC10, and the PCB9 in parallel with the data transfer line 11 to supply gate driver control signals. In this type of structure, the gate driver control signals might cause interference such as common mode noise in the data transfer line 11. However in the present embodiment, the wires for supplying the gate driver control signals to the gate driver 5 are only formed between the data drivers 4L, 4R and the gate driver 5 so that these gate driver control signals cause no interference problems.

Figure 6:
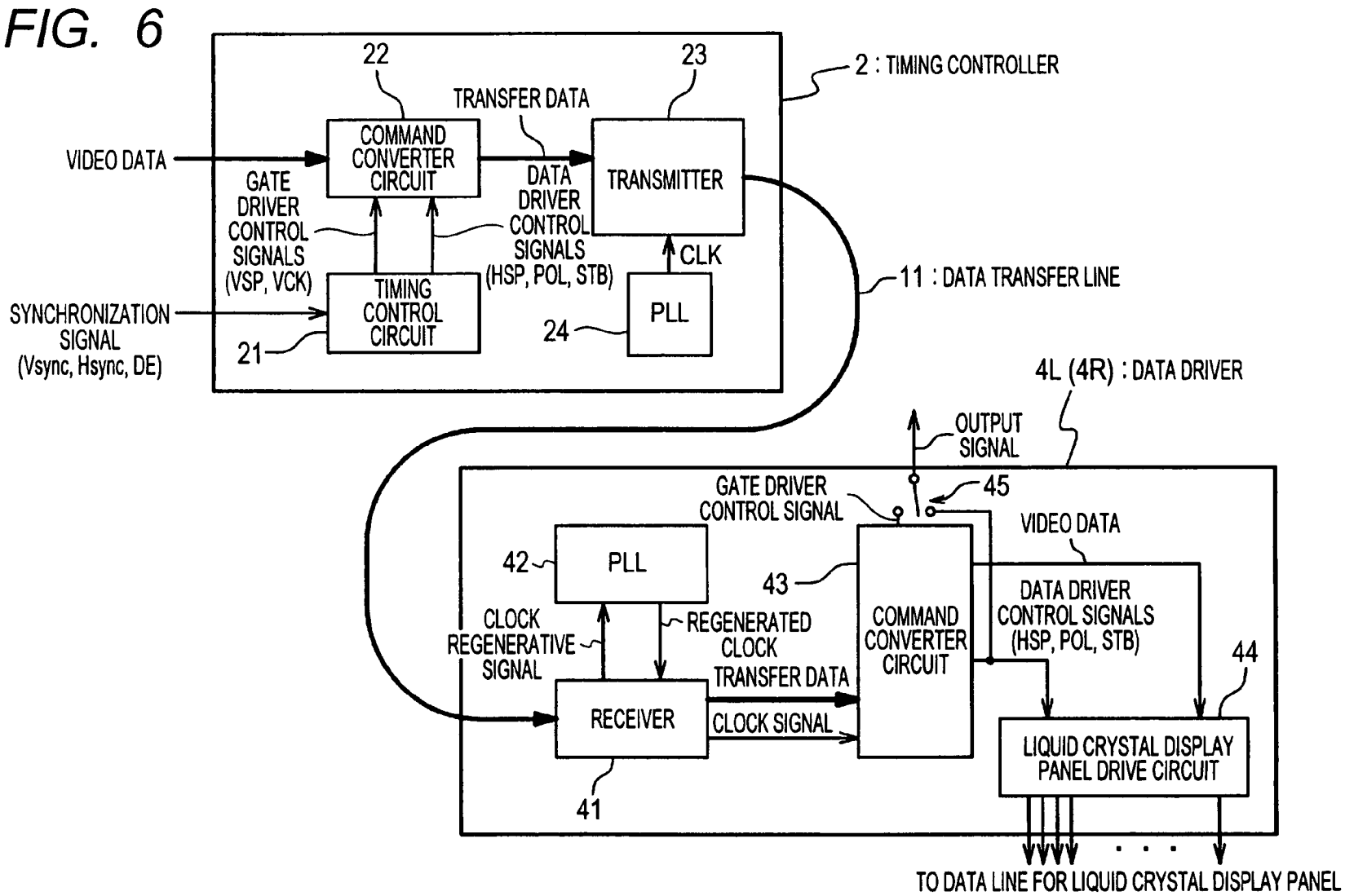
FIG. 6 is a block diagram for showing the structure of the timing controller and data driver in another aspect of the present invention.

FIG. 6 is a block diagram showing the structure of the data drivers 4L, 4R in another embodiment of the invention. The data driver 4L, 4R structure shown in FIG. 6 is almost identical to that shown in FIG. 3 but differs in the point that a selector 45 was added. During normal operation, the selector 45 selects the gate driver control signal, and outputs the gate driver control signal from an output pin coupled to the output of the selector 45. However during test operation, the selector 45 outputs a data driver control signal (at least one signal) to an external section from an output pin coupled to the output of the selector 45. This type of operation allows directly observing the waveform of the data driver control signal and improves testability without increasing the number of output pins on the data drivers 4L, 4R.

The preferred embodiments of the present invention were specifically described above but the invention is not limited by the above described embodiments. Those skilled in the art may make all manner of self-evident changes without departing from the scope and spirit of the present invention.

In the above description for example, the data drivers 4L, 4R positioned on both ends (of the timing controller) supplied gate driver control signals to the gate driver 5. However, data drivers 4 that are not positioned on both ends (of the timing controller) may supply gate driver control signals to the gate driver 5. A structure may be employed for example where the data driver 4 installed second from the left supplies gate driver control signals to the gate driver 5 mounted in the left side of the liquid crystal display panel 3. However a structure in which the data drivers 4L, 4R positioned on both ends, (namely, the data drivers 4 closest to the gate drivers 5L, 5R) supply gate driver control signals to the gate driver 5 is preferable in order to shorten the length of wires formed between the data driver 4 and the gate driver 5 for supplying gate driver control signals.

The description in the above embodiment presents a liquid crystal display device. However, as is evident to one skilled in the art, the present invention is also applicable to display devices utilizing display panels other than the liquid crystal display panels (e.g. in plasma display panels and organic EL panels). In this case also, the control signals are supplied to the driver that drives the scanning lines (namely, wires for selecting lines of pixels to be driven on the display panel) from a driver for driving the signal lines (namely, wires driven according to the pixel hierarchy on the display panel). This structure reduces the number of wires required for supplying video data and control signals, and eliminates effects from noise that control signals supplied to the scanning line driver exert on the data transfer lines that supply the video data.

What is claimed is:

1. A display device, comprising:

a display panel;

a timing controller;

a plurality of signal line drivers to drive display panel signal lines; and a seaming line driver to drive scanning lines on the display panel, wherein the timing controller supplies control data to a specified driver among the signal line drivers, and wherein the specified driver generates scanning line driver control signals to control the scanning line drivers in a response to the control data, and supplies scanning line driver control signals to the scanning line driver, wherein the specified driver includes:

a drive circuit to drive the signal lines of the display panel;

a control signal generator circuit to generate signal line driver control signals to control the drive circuit from the control data, and to generate the scanning line driver control signals;

output pins coupled to the scanning line driver; and a selector to select either the signal line driver control signal or the scanning line driver control signals, wherein the selector is configured to output a selected one of the signal line driver control signal and the scanning line driver control signals from the output pin, and wherein, during a test operation, the selector selects the signal line driver control signal, from the signal line driver control signal and the scanning line driver control signals, and outputs the signal line driver control signal from the output pins.

2. The display device according to claim 1, wherein the data transfer line couples the timing controller and the specified driver, and wherein the timing controller supplies both control data and video data corresponding to images displayed on the display panel to the specified driver by way of the video transfer line.

3. The display device according to claim 2, wherein the timing controller generates data transfer signals corresponding to transfer data containing the control data and the video data in synchronization with clock signals, and sends the data transfer signals to the specified driver by way of the data transfer line, and wherein the specified driver regenerates the clock recovery signals from the data transfer signals and obtains the control data and the video data by sampling the data transfer signals in a response to the clock recovery signals.

4. The display device according to claim 3, wherein the specified driver comprises a nearest driver coupled to the scanning line driver among the signal line drivers.

5. The display device according to claim 2, wherein the specified driver comprises a nearest driver coupled to the scanning line driver among the signal line drivers.

6. The display device according to claim 1, wherein the plural signal line drivers include a non-coupled driver that is not connected to the scanning line driver, and wherein the non-coupled driver and the specified driver possess identical structures.

7. The display device according to claim 6, wherein the specified driver comprises a nearest driver coupled to the scanning line driver among the signal line drivers.

8. The display device according to claim 1, wherein the specified driver comprises a nearest driver coupled to the scanning line driver among the signal line drivers.

9. The display device according to claim 1, wherein the specified driver comprises a nearest driver coupled to the scanning line driver among the signal line drivers.

10. The display device according to claim 1, wherein, during a normal operation, the selector selects the scanning line driver control signals, from the signal line driver control signal or the scanning line driver control signals, and outputs the scanning line driver control signals from the output pins.

11. A signal line driver, comprising:

a receiver to receive transfer data including video data and control data from a timing controller;

a drive circuit to drive display panel signal lines in a response to the video data; and a control signal generator circuit to generate control signals to control the scanning line driver that drives the scanning lines in the display panel in a response to the control data;

an output pin connected to the scanning line driver; and a selector, wherein the control signal generator circuit generates signal line driver control signals to control the drive circuit from the control data, wherein the selector selects control signals from either the signal line driver control signals or the scanning line driver control signals, and outputs a selected one of the signal line driver control signal and the scanning line driver control signals from the output pin, and wherein, during a test operation, the selector selects the signal line driver control signal, from the signal line driver control signal and the scanning line driver control signals, and outputs the signal line driver control signal from the output pins.

12. The signal line driver according to claim 11, wherein, during a normal operation, the selector selects the scanning line driver control signals, from the signal line driver control signal or the scanning line driver control signals, and outputs the scanning line driver control signals from the output pins.

* * * * *